US006203354B1

(12) United States Patent
Kuwahara et al.

(10) Patent No.: US 6,203,354 B1
(45) Date of Patent: Mar. 20, 2001

(54) ELECTRICAL CONNECTOR HAVING FIRST AND SECOND CONNECTOR MEMBERS AND LOCKING STRUCTURE THEREFOR

(75) Inventors: Masanori Kuwahara; Makoto Higashikozono, both of Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 09/358,369

(22) Filed: Jul. 21, 1999

(30) Foreign Application Priority Data

Jul. 22, 1998 (JP) ..... 10-206719

(51) Int. Cl.[7] ..... H01R 13/627
(52) U.S. Cl. ..... 439/357; 439/352
(58) Field of Search ..... 439/357, 352, 439/350, 282, 281, 369, 372, 278, 279, 353, 354

(56) References Cited

U.S. PATENT DOCUMENTS

| | | | | |
|---|---|---|---|---|
| 2,677,115 | * | 4/1954 | Stevens | 339/60 |
| 3,953,099 | | 4/1976 | Wilson | 339/60 |
| 4,283,106 | * | 8/1981 | Bunnell | 339/125 |
| 4,311,355 | | 1/1982 | Plyler et al. | 277/207 |
| 4,556,226 | | 12/1985 | Ito | 339/94 M |
| 4,611,872 | | 9/1986 | Ito et al. | 339/94 M |
| 4,709,123 | | 11/1987 | Yamashita et al. | 174/52 R |
| 5,368,499 | * | 11/1994 | Hirt | 439/350 |
| 5,474,465 | * | 12/1995 | Kobayashi | 439/278 |
| 5,484,301 | | 1/1996 | Koumatsu et al. | 439/271 |

FOREIGN PATENT DOCUMENTS

| | | |
|---|---|---|
| 0 338 727 A2 | 10/1989 | (EP) . |
| 0 704 937 A2 | 4/1996 | (EP) . |
| 50-55584 | 5/1975 | (JP) . |

* cited by examiner

*Primary Examiner*—Gary Paumen
*Assistant Examiner*—Alexander Gilman
(74) *Attorney, Agent, or Firm*—Oliff & Berridge, PLC

(57) ABSTRACT

An electrical connector has first and second connector members containing one or respective pairs of terminals. In the housing of the first member, the terminals are projections. In the housing of the second member the terminals are recesses which receive the projections. A locking projection on the first member is received in a separate recess of the second member, and does not project outside the second member in the connected state. The connector is compact and has a smooth exterior shape.

21 Claims, 5 Drawing Sheets

ELECTRICAL CONNECTOR HAVING FIRST AND SECOND CONNECTOR MEMBERS AND LOCKING STRUCTURE THEREFOR

BACKGROUND OF THE INVENTION

1. Field of Invention

The invention relates to an electrical connector. One possible use of the connector is for electric connection of wiring of solar panel modules and of solar panels. The invention is also applicable to a bipolar connector. The invention also relates to an assembly of solar panels electrically connected by at least one of the connectors.

2. Description of Related Art

A solar panel for use in a solar-energy power generation system is constructed of a plurality of modules connected with one another in series. A connector is used for electrical connection of the modules.

A plurality of the solar panels are connected to one another to compose a solar panel array. Similar connectors are used to connect the solar panels to one another as are used to connect the modules.

A connector of this kind is constructed of a plug-side connector member having a plug terminal or male terminal and a socket-side connector member having a socket terminal or female terminal. The plug terminal and the socket terminal are electrically connected with each other by interengaging fitting parts provided on housings of the connector members.

In equipping a building with the solar-energy power generation system, generally, a solar panel is installed on a roof after completion of the building and an electric connection is made. This method is hereinafter referred to as the post-placing construction method. In the post-placing construction method, it is possible to secure a sufficiently large space between the solar battery panel and the roof.

However, in recent years, for cost reduction, there is proposed a method of integrating the panel with a building or roofing material and incorporating this building material into the roof during the construction of the building. This method is hereinafter referred to as the panel-building material integration construction method.

Unlike the post-placing construction method, in the panel-building material integration construction method, it is difficult to secure a large wiring space around the solar battery panel. Thus, there is a growing demand for the development of a compact connector.

However, the connector described above has the following problem:

In many cases, the connector is provided with a locking mechanism to prevent the connector members from being disconnected from each other.

The locking mechanism has a locking pin formed on one of the connector members and a locking element formed on the other connector member. The locking function is performed by the engagement between the locking pin and the locking element when the connector members are connected with each other, for example as disclosed in U.S. Pat. No. 4,556,226 (corresponding to Japanese Laid-Open Utility Model No. 60-19157).

In this connector, the locking pin projects outward from the periphery of the housing of one connector member and the cooperating locking element projects outward from the periphery of the housing of the other connector in a direction perpendicular to a direction in which the locking pin is fitted in the locking element.

Thus, the locking pin and the locking element increase the outside dimension of the connector in a direction perpendicular to the direction in which the locking pin is fitted into the locking element.

A bipolar connector having two terminals for use in the solar-energy power generation system having many modules has a larger outside dimension than a one-pole connector. Further, the outside dimension of the bipolar connector is increased by the locking mechanism.

Therefore, it may be difficult to form connections using the connector members. The connector may interfere with the solar panel, thus making the work of installing the solar panel difficult; or the connector may be pressed against the solar panel and damaged.

U.S. Pat. No. 4,709,123 illustrates an electrical connector for a motor vehicle in which a first connector member has a rectangular casing from which projects an elliptical portion containing terminals in a recess. This recess receives a second member carrying terminals. A locking projection extending forwardly from the elliptical portion engages a bracket on the second member. The elliptical portion and second member are covered by a rubber cover. The exterior of the rectangular casing carries another locking member.

Japanese Laid-Open Patent Application 50-55584 shows a bipolar connector in which a projection containing terminals is received in a recess also containing terminals. The member having the recess has an elliptical locking flange which locks to a locking lip on the member having the projection. The member having the projection is elliptical in section.

U.S. Pat. No. 4,311,355 discloses a waterproof bipolar connector in which a first member has two projections containing terminals which are received in corresponding recesses in a second member. An oval seal surrounds both projections and seals to an oval front recess of the second member. The two members are locked together by external pivoting latches.

SUMMARY OF THE INVENTION

One aspect of the invention seeks to reduce or avoid the problems described above in connection with solar panels and to provide a connector which is suitable for general use. Another aspect of the invention is to provide a compact connector for electric connection which is compact due to a locking mechanism haivng a minimized outside dimension.

According to one preferred embodiment of the invention, there is provided an electrical connector including a first connector member and a second connector member lockingly connectable with the first connector member in a connected state. The first connector member has a first housing and at least one first electrical terminal. The first housing has a front end, at least one forwardly projecting portion in which the at least one first electrical terminal is housed and a forwardly projecting locking projection, including a first locking element, extending alongside the forwardly projecting portion. The second connector member has a second housing and at least one second electrical terminal, the second housing having a front end, at least one rearwardly extending terminal recess in which the at least one second terminal is housed and a rearwardly extending locking recess, including a second locking element, extending alongside the terminal recess.

In the connected state, the at least one forwardly projecting portion of the first housing is received in the at least one terminal recess of the second housing whereby the at least one first electrical terminal and the at least one second electrical terminal engage so as to make an electrical connection, and the locking projection is received in the locking recess so that the first and second locking elements interengage thereby locking the first and second connector members together. The first locking element is housed within the locking recess in the connected state so as not to project outwardly of the second housing.

In this construction of the invention, the interengaging projection(s) and recess(es) containing the terminals provide stable and safe connection of the terminals, while the separate locking projection and recess restrain the connector members from being disconnected from each other. The first locking element does not project outwardly from a periphery of the housing of the second connector member.

Therefore, the invention is capable of complying with the demand for the development of a compact connector. In particular, the invention can provide a compact bipolar connector.

In embodiments, it is unnecessary to rotate the connector members relative to one another after they have been fitted together or to perform any other locking operations.

In yet another preferred embodiment, the connector members can be disconnected from each other by merely pulling apart with a force sufficient to disengage the locking elements by elastic deformation. Therefore, the construction allows a disengaging operation to be performed easily.

When the locking projection of a bipolar connector is positioned offset with respect to the line connecting the terminals with each other, mis-fitting is avoided.

Thus, if the position of the locking recess and that of the locking projection do not align with each other, it is impossible to connect connector members with each other. Thus, there is no possibility that the connector members are connected with each other erroneously.

Among the shapes possible for the periphery of the connector members the elliptical shape and the race-track shape (round ends and straight sides) are preferred. Thus, when the elliptical connector is arranged in such a manner that its vertical length is longer than its horizontal length and if the connector interferes with a module of a solar panel, it is possible to reduce or avoid the interference by re-arranging the connector (or allowing it to fall down) in such a manner that its horizontal length is longer than its vertical length.

To provide a smooth exterior, avoiding projections which may hinder the easy manipulation and placing of the connector in a tight space, preferably the first and second housings have respective exterior peripheral surface portions which in the connected state of the connector adjoin each other in a flush manner over at least one-half of the circumferential extent of the connector.

BRIEF DESCRIPTION OF THE DRAWINGS

Preferred embodiments of the invention and modifications thereof will now be described with reference to the accompanying drawings, in which.

DETAILED DESCRIPTION OF PREFERRED EMBODIMENTS

Figure 1:
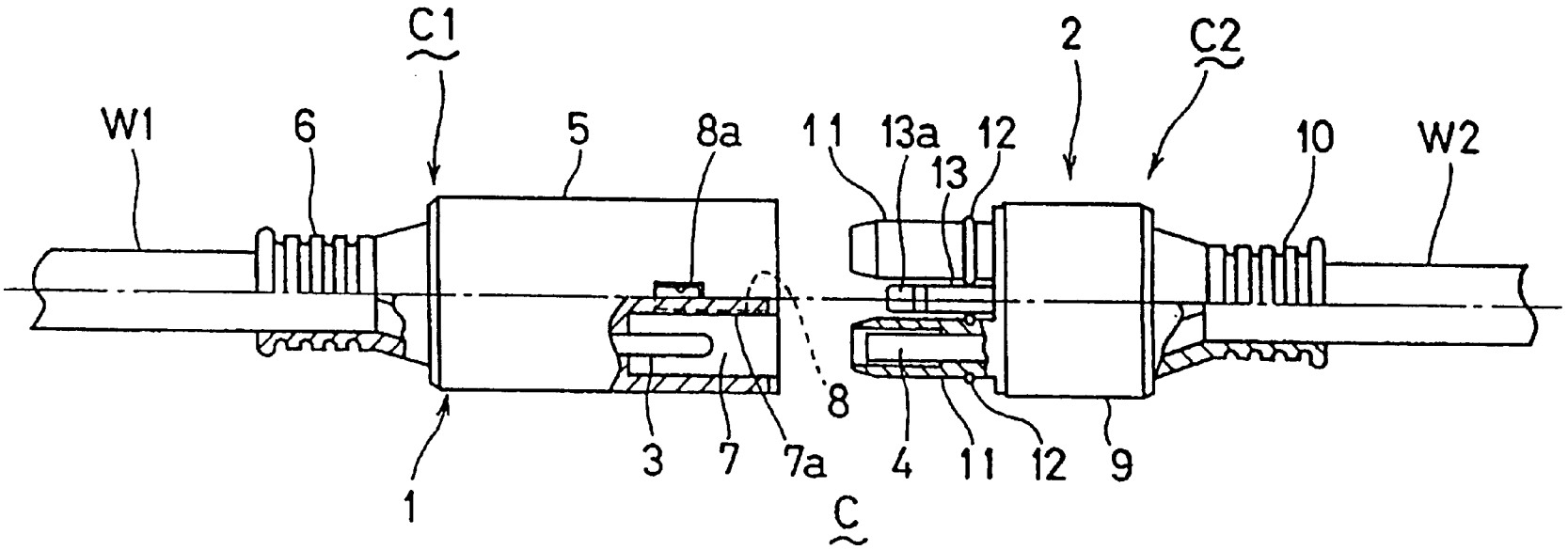
FIG. 1 is a front view partly in section showing a state before a plug-side connector member and a socket-side connector member together constituting the connector of a preferred embodiment of the invention are connected with each other.

A bipolar connector embodying the invention will be described below with reference to FIGS. 1 to 8. A connector C for electric connection includes a plug-side connector member C1 having a housing 1 accommodating a pair of plug terminals 3 and a socket-side connector member C2 having a housing 2 accommodating a pair of socket or receptacle terminals 4. The connector members C1 and C2 are connected with each other to constitute the connector C.

The housing 1 of the plug-side connector member C1 has a sealing portion 6 connected with a rear side of a housing body 5. The sealing portion 6 is formed of an elastic material (typically, rubber) and is in close contact with the peripheral surface of an electric wire W1 to waterproof the plug-side connector member C1 securely.

The housing body 5 is made of plastics such as modified PPO or the like and is elliptical in its transverse cross-sectional shape (a section perpendicular to a direction in which a fitting projection 11 is fitted in a fitting recess 7).

A pair of terminal recesses in the form of fitting recesses 7 is provided in the housing body 5 extending rearwardly from the front end thereof at both sides in the major axis direction thereof. The recesses 7 serve as a female fitting part and extend axially in parallel with each other, with an insulation wall 7*a* having a thickness necessary for electric insulation interposed between them. The plug terminals 3 are positioned at the centers of the recesses 7, respectively.

A locking recess 8 having a locking element is formed in the housing body 5 at the center of the front portion thereof in the major axis direction thereof and extends rearwardly parallel with the recesses 7.

Figure 2:
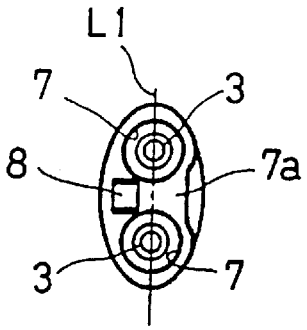
FIG. 2 is an end view of the plug-side connector member of FIG. 1.
Figure 3:
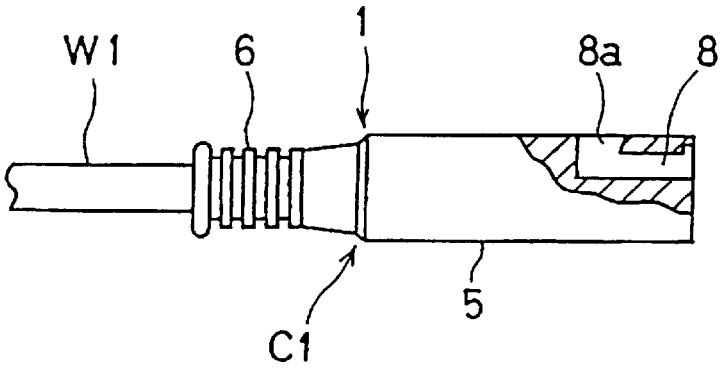
FIG. 3 is a plan view partly in section of the plug-side connector member of FIG. 1.

As shown in FIGS. 2 and 3, the locking recess 8 is positioned at one side in the minor axis direction of the housing body 5 with respect to a line L1 connecting the plug terminals 3 with each other, without disturbing the overall elliptical periphery of the housing body 5. That is, the locking recess 8 is positioned within the length of the minor axis of the housing body 5. A rear portion of the locking recess 8 is perpendicular to the main portion thereof (i.e. is perpendicular to the axis of the housing body 5) and is open at the periphery of the housing body 5 at an opening 8*a* as shown in FIGS. 1, 3, 6 and 7.

The housing 2 of the socket-side connector member C2 has a sealing portion 10 located at the rear side of the housing body 9 and has a pair of hollow cylindrical projections 11 serving as male fitting projections located at the front part of the housing body 9 and extending forwardly to the front end thereof.

Similar to the sealing portion 6 of the plug-side connector member C1, the sealing portion 10 is made of an elastic material such as rubber, and is in close contact with the peripheral surface of an electric wire W2 to waterproof the housing 2.

The housing body 9 is made of plastics such as modified PPO or the like and is elliptical in transverse cross-section. The shape and cross-sectional size of the housing body 9 are the same as those of the housing body 5 of the connector member C1. When the connector members C1 and C2 are connected with each other, their elliptical peripheral surfaces become mutually flush and continuous with each other.

The projections 11 are so shaped as to be fitted slidingly in the recesses 7 of the plug-side connector member C1, respectively. The socket terminals 4 are provided in the cylinders 11 respectively.

A waterproofing O-ring 12 is installed in a groove on the peripheral surface of the rear end of each of the projections 11. When the members C1 and C2 are connected with each other, each O-ring 12 provides a waterproof seal between the projection 11 and the wall of the recess 7. The O-rings 12 are formed of an elastic material (for example, silicone rubber having a durometer hardness of less than 60 Hs and optionally containing silicone oil) suitable for obtaining a high degree of water tightness with a low degree of a fitting resistance.

As described above, the waterproof construction is applied separately for the two poles. Thus, generation of a leak current is conceivable only when both projections 11 and both recesses 7 are exposed to water. The possibility of the generation of leak current is therefore lower than with a single waterproof construction which is applied to both poles.

Figure 4:
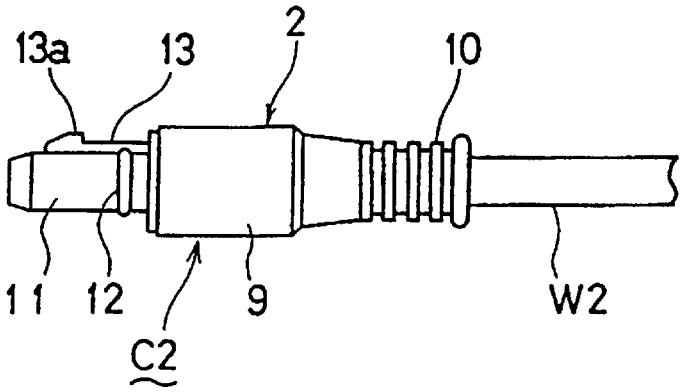
FIG. 4 is a plan view of the socket-side connector member of FIG. 1.
Figure 5:
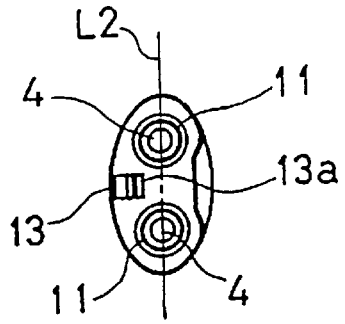
FIG. 5 is an end view of the socket-side connector member of FIG. 1.

A cantilevered rod-like locking projection 13 extends forwardly on the housing body 9 towards its front end. The locking projection 13 is positioned at the center of the housing body 9 in the major axis direction thereof and parallel with the projections 11. As shown in FIGS. 4 and 5, in correspondence to the locking recess 8 of the connector member C1, the locking projection 13 is positioned at one side of the housing body 9 in the minor axis direction thereof with respect to a line L2 connecting the socket terminals 4 with each other such that the locking projection 13 does not project to the outside of the projected outer peripheral surface of the housing body 9 (i.e. perpendicular to the direction in which the projections 11 are fitted in the recesses 7). That is, the locking recess 8 and the locking projection 13 are positioned within the length of the minor axis of the housing body 9. A locking nose 13*a* capable of engaging the opening 8*a* of the locking recess 8 elastically is formed at the front end of the locking projection 13.

To minimize risk of an operator receiving an electric shock, the diameter of the recesses 7 of the plug-side connector member C1 and the inner diameter of the cylindrical projections 11 of the socket-side connector member C2 are such that the operator's finger does not contact the terminals 3 and 4 when pressed against the front ends of the connector members.

Figure 6:
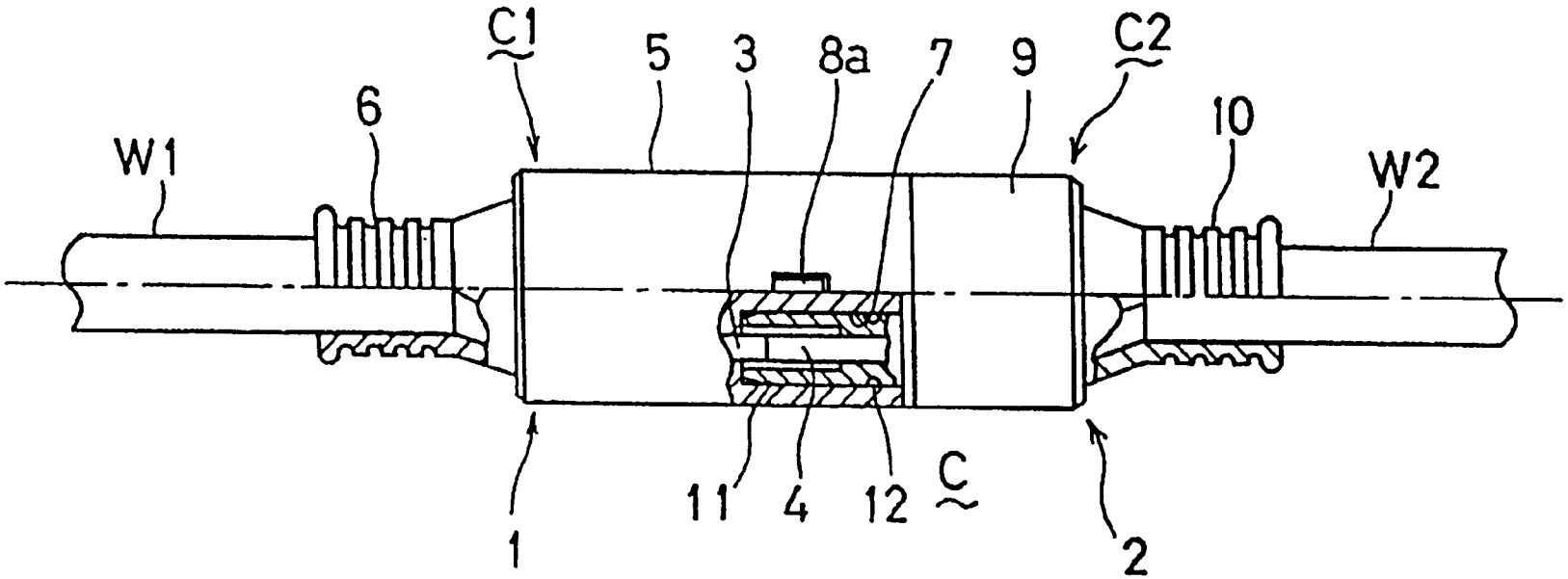
FIG. 6 is a front view partly in section showing a state in which the connector members of FIG. 1 have been connected with each other.

When the members C1 and C2 are connected with each other, the projections 11 are received in the recesses 7, respectively, as shown in FIG. 6. At this time, the locking projection 13 is inserted into the locking recess 8, and the locking nose 13*a* engages in the opening 8*a* elastically, thus restraining the members C1 and C2 from being disconnected from each other.

In this manner, the members C1 and C2 are connected with each other, and the plug terminals 3 and the socket terminals 4 are electrically connected with each other.

In this connector C, the locking recess 8 and the locking projection 13 constituting the locking mechanism are provided inside the elliptical periphery of the housing bodies 5 and 9, respectively. Thus, the locking mechanism does not increase the outside dimension or outer diameter of the connector C. The fitting of the projections 11 in the recesses 7 gives stability and prevents rotation of the members.

Therefore, the invention is capable of complying with the demand for a compact connector. In particular, the invention is advantageous because it provides a compact bipolar connector.

The locking mechanism provides at least the following advantages:

(1) The locking recess 8 and the locking projection 13 are parallel with the fitting recesses 7 and the fitting projections 11, respectively. The locking function is accomplished by the elastic engagement between the locking nose 13*a* and the opening 8*a* of the locking hole 8. Thus, the locking operation is obtained by only inserting the projections 11 into the recesses 7. Thus, it is unnecessary to perform a locking operation of rotating the plug-side connector member C1 and the socket-side connector member C2 relative to each other after the fitting projections 11 are fitted in the fitting recesses 7 or perform other locking operations.

Figure 7:
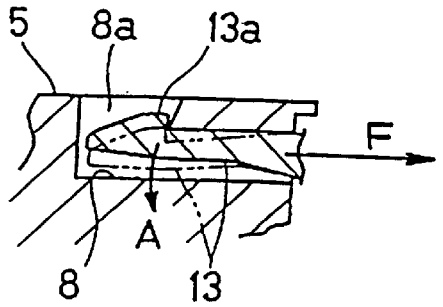
FIG. 7 is an enlarged sectional view showing a locking mechanism in the state in which the connector members of FIG. 1 have been connected with each other.
Figure 8:
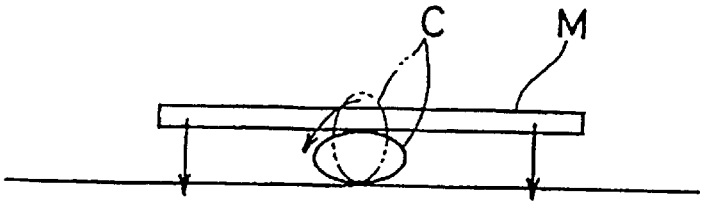
FIG. 8 is a diagrammatic view explaining the operation of the connector of FIG. 1.

As shown by a broken line in FIG. 7, the connector members C 1 and C2 can be disconnected from each other by merely pulling out the locking projection 13 with a force F sufficient to disengage the nose 13*a* from the opening 8*a* of the locking recess 8 by the elastic deformation of the locking projection 13 which occurs in a direction shown with an arrow A.

(2) The locking recess 8 is positioned at one side with respect to the line L1 connecting the plug terminals 3 with each other, and the locking projection 13 is positioned at one side with respect to the line L2 connecting the socket terminals 4 with each other. If the position of the locking recess 8 and that of the locking projection 13 do not align with each other, it is impossible to connect the plug terminal of the member C1 and the receptacle terminal of the member C2 with each other. Thus, there is no possibility that the members C1 and C2 are connected with each other erroneously.

The housing bodies 5 and 9 of the connector members C1 and C2 have matching portions which are elliptical in section. Thus, when the elliptical connector C is arranged in such a manner that its vertical length is longer than its horizontal length, as shown with a broken line of FIG. 8, so that it may interfere with a module M of a solar panel, it is possible to avoid such interference by installing the connector C, or allowing it to fall down, in such a manner that its horizontal length is longer than its vertical length (vertical length of the connector C is minimum), as shown by the solid line of FIG. 8.

While many modifications and variations are possible within the scope of the invention herein disclosed, a few will be mentioned below.

(1) To operate the locking mechanism, the locking nose 13*a* elastically engages the opening 8*a* merely by inserting the locking projection 13 into the locking recess 8. To obtain a stronger locking function, it is possible to adopt a locking construction which is operable by rotating the plug-side connector member C1 and the receptacle-side connector member C2 relative to each other after the fitting projection 11 is fitted in the fitting recess 7.

(2) Each locking element (the locking recess 8 and the locking projection 13) is formed at one side with respect to the line connecting the terminals with each other. Alternatively, each locking element may be formed on the line connecting the terminals with each other.

(3) The housing body 5 of the plug-side connector member C1 and the housing body 9 of the socket-side connector member C2 are elliptical in section. Alternatively, they may be circular in section or polygonal, for example, rectangular (with or without rounded corners) or racetrack-shaped (semicircular ends and straight sides).

Figure 9:
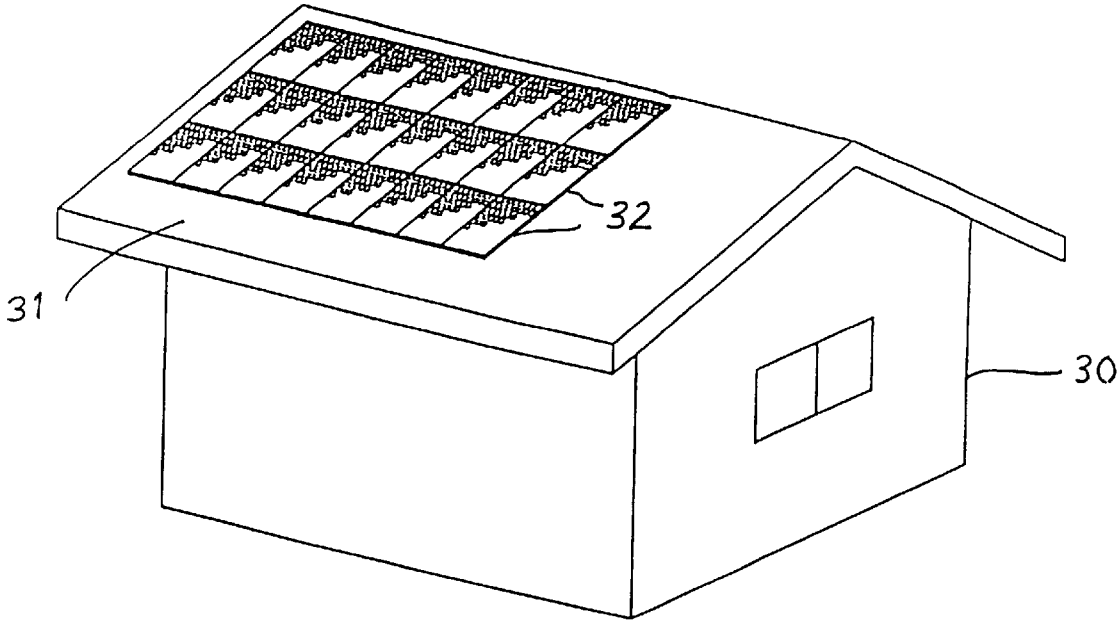
FIG. 9 is a diagrammatic view of a building having an array of solar panels with which the connector of the invention may be employed.
Figure 10:
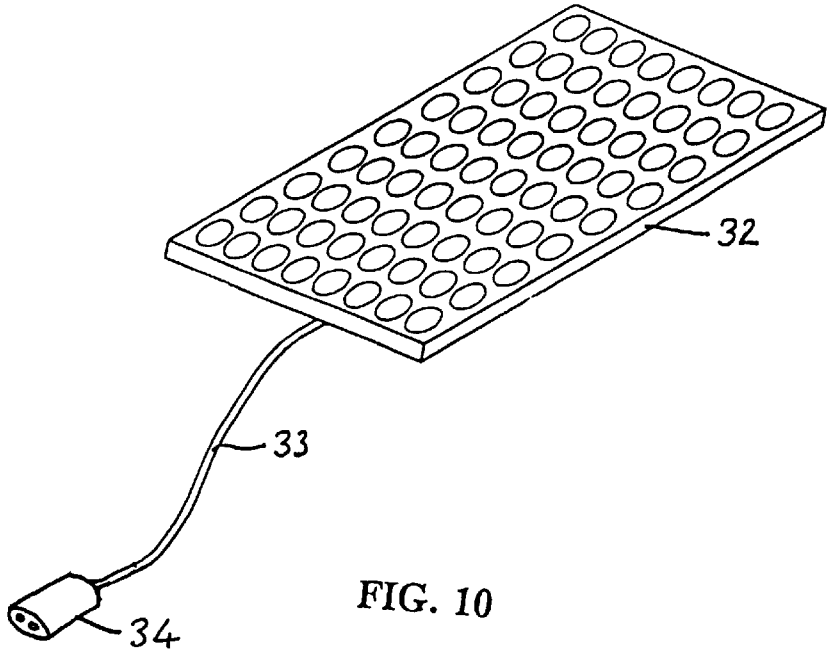
FIG. 10 is a view of a solar panel including connector components according to preferred embodiments of the invention.

FIG. 9 shows a building 30 having a roof 31 whose exterior face is partly composed of an array of solar panels 32. Such solar panels are electrically interconnected, e.g. in series, by connectors of the invention such as shown in FIGS. 1 to 8. FIG. 10 shows one solar panel 32 having a two-wire electrical cable 33 connected into a connector member 34. This connector member 34 may be a plug-side member C1 of FIGS. 1 to 8 or a socket-side member C2 of FIGS. 1 to 8. The connectors may also be used for connecting solar panels to exterior circuits. The connector is compact, strong and easy to connect correctly in the confined spaces available in, for example, a roof.

While preferred embodiments of this invention have been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. An electrical connector, comprising:

a first connector member and a second connector member connectable with the first connector member in a connected state;

said first connector member having a first housing and at least one first electrical terminal, said first housing having a front end, at least one forwardly projecting portion in which said at least one first electrical terminal is housed and a forwardly projecting cantilevered rod-like locking projection that is located within a projected outer peripheral surface of the first housing, including a first locking element, extending alongside said at least one forwardly projecting portion; and said second connector member having a second housing and at least one second electrical terminal, said second housing having a front end, at least one rearwardly extending terminal recess in which said at least one second electrical terminal is housed and a rearwardly extending locking recess, including a second locking element, extending alongside said at least one terminal recess, wherein, in said connected state, said at least one forwardly projecting portion of said first housing is received in said at least one terminal recess of said second housing whereby said at least one first electrical terminal and said at least one second electrical terminal engage so as to make electrical connection, and said locking projection is received in said locking recess so that said first and second locking elements interengage thereby locking said first and second connector members together and said first locking element is housed within said locking recess in said connected state so as not to project outwardly of said second housing.

2. An electrical connector according to claim 1, wherein said first and second housings have respective exterior peripheral surface portions which in said connected state adjoin each other in a flush manner over at least one-half of the circumferential extent of the connector.

3. An electrical connector according to claim 1, wherein in said connected state, said electrical connector has a transverse cross-sectional shape which is either elliptical or race-track shape.

4. The electrical connector according to claim 1, further comprising sealing means located on a rear end of the first housing for waterproofing the rear end of the first housing.

5. The electrical connector according to claim 1, further comprising sealing means located on a rear end of the second housing for waterproofing the rear end of the second housing.

6. The electrical connector according to claim 1, wherein the forwardly projecting locking projection has a locking nose at a front end of the locking projection.

7. The electrical connector according to claim 1, wherein each of the at least one forwardly projecting portion and each of the at least one rearwardly extending terminal recess is longer than each of the at least one first electrical terminal and each of the at least one second electrical terminal, respectively.

8. The electrical connector according to claim 1, wherein the first housing is made of a modified PPO.

9. The electrical connector according to claim 1, wherein the second housing is made of a modified PPO.

10. An electrical connector according to claim 1, wherein said first housing has two forwardly projecting portions extending parallel to each other and respectively housing two first electrical terminals, and said second housing has two terminal recesses extending parallel to each other and respectively housing two second electrical terminals, said locking projection extending parallel to said two forwardly projecting portions and said locking recess extending rearwardly parallel to said two terminal recesses.

11. An electrical connector according to claim 10, wherein the end of said locking projection is located rearwardly of the ends of said forwardly projecting portions.

12. An electrical connector according to claim 10, wherein, as seen in the transverse cross-section, said locking projection is located offset from said two first electrical terminals.

13. The electrical connector according to claim 1, further comprising sealing means located on a rear end of each of the at least one forwardly projecting portion so as to provide a waterproof seal between each of the at least one forwardly projecting portion and each of the at least one rearwardly extending terminal recess when in the connected state.

14. The electrical connector according to claim 13, wherein the sealing means is made of silicon rubber having a durometer hardness of less than 60 Hs.

15. The electrical connector according to claim 14, wherein the sealing means also contains silicone oil.

16. The electrical connector according to claim 13, wherein the sealing means is an O-ring.

17. The electrical connector according to claim 16, wherein the O-ring is made of silicon rubber having a durometer hardness of less than 60 Hs.

18. The electrical connector according to claim 17, wherein the O-ring also contains silicone oil.

19. An assembly of solar panels, comprising:

at least first and second solar panels; and an electrical connector connecting the first and second panels, comprising:

a first connector member and a second connector member connectable with the first connector member in a connected state;

said first connector member having a first housing and at least one first electrical terminal, said first housing having a front end, at least one forwardly projecting portion in which said at least one first electrical terminal is housed and a forwardly projecting cantilevered rod-like locking projection that is located within a projected outer peripheral surface of the first housing, including a first locking element, extending alongside said at least one forwardly projecting portion; and said second connector member having a second housing and at least one second electrical terminal, said second housing having a front end, at least one rearwardly extending terminal recess in which said at least one second electrical terminal is housed and a rearwardly extending locking recess, including a second locking element, extending alongside said at least one terminal recess, wherein, in said connected state, said at least one forwardly projecting portion of said first housing is received in said at least one terminal recess of said second housing whereby said at least one first electrical terminal and said at least one second electrical terminal engage so as to make electrical connection, and said locking projection is received in said locking recess so that said first and second locking elements interengage thereby locking said first and second connector members together and said first locking element is housed within said locking recess in said connected state so as not to project outwardly of said second housing.

20. An electrical connector, comprising:

a first connector member and a second connector member connectable with the first connector member in a connected state;

said first connector member having a first housing and at least one first electrical terminal, said first housing having a front end, at least one forwardly projecting portion extending at least a length of said at least one first electrical terminal in which said at least one first electrical terminal is housed, and a forwardly projecting cantilevered rod-like locking projection, that is located within a projected outer peripheral surface of the first housing including a first locking element extending alongside said at least one forwardly projecting portion; and said second connector member having a second housing and at least one second electrical terminal, said second housing having a front end, at least one rearwardly extending terminal recess extending at least a length of said at least one second electrical terminal in which said at least one second electrical terminal is housed and a rearwardly extending locking recess, including a second locking element, wherein, in said connected state, said at least one forwardly projecting portion of said first housing is received inside at least one terminal recess of said second housing whereby said at least one first electrical terminal and said at least one second electrical terminal engage so as to make electrical connection, and said locking projection is received in said locking recess so that said first and second locking elements interengage thereby locking said first and second connector members together.

21. The electrical connector according to claim 20, wherein each of the at least one forwardly projecting portion and each of the at least one rearwardly extending terminal recess is longer than each of the at least one first electrical terminal and each of the at least one second electrical terminal, respectively.

* * * * *